United States Patent [19]

Wagner et al.

[11] 4,225,250

[45] Sep. 30, 1980

[54] SEGMENTED-RING MAGNET PRINT HEAD

[75] Inventors: Richard E. Wagner, Bellevue; Verivada Chandrasekaran, Kirkland; Edward D. Bringhurst, Seattle, all of Wash.

[73] Assignee: Tally Corporation, Kent, Wash.

[21] Appl. No.: 949,876

[22] Filed: Oct. 10, 1978

[51] Int. Cl.[3] ..... B41J 3/12

[52] U.S. Cl. ..... 400/124; 101/93.05

[58] Field of Search ..... 400/124; 101/93.05; 335/302–304, 306

[56] References Cited

U.S. PATENT DOCUMENTS

| | | | |
|---|---|---|---|
| 3,177,546 | 4/1965 | Bey | 335/302 X |
| 3,467,232 | 9/1969 | Paige | 400/124 |
| 3,592,311 | 7/1971 | Chou et al. | 400/124 |
| 3,659,238 | 4/1972 | Griffing | 335/229 |
| 3,941,051 | 3/1976 | Barrus et al. | 101/93.04 |
| 4,004,673 | 1/1977 | Burzlaff et al. | 400/124 |
| 4,033,255 | 11/1975 | Kleist et al. | 101/93.04 |
| 4,037,704 | 7/1977 | Golobay et al. | 400/124 |
| 4,044,668 | 8/1977 | Barrus et al. | 101/93.04 |
| 4,079,824 | 3/1978 | Ku | 101/93.05 X |
| 4,136,978 | 1/1979 | Bellinger et al. | 400/124 |

OTHER PUBLICATIONS

IBM Tech. Disc. Bulletin, by J. H. Meier et al., vol. 20, No. 11B, Apr., 1978, pp. 4748–4749.

*Primary Examiner*—Paul T. Sewell

*Attorney, Agent, or Firm*—Christensen, O'Connor, Johnson & Kindness

[57] ABSTRACT

A print head for a serial dot matrix printer comprising a sandwich structure including a base plate, a segmented-ring magnet, a print hammer disc and face plate is disclosed. The segmented-ring magnet comprises a ring formed of a magnetic material having spaced apart, magnetized, regions (segments). The print hammer disc is formed of a magnetically permeable, resilient material and has a plurality of inwardly projecting arms (hammers), each of which is aligned with a magnetized segment. Mounted on the hammers are print blades, which are aligned with radial slots formed in the face plate. Each print blade includes a dot-printing tip that projects orthogonally outwardly from the blade, and lies in a central aperture in the face plate. Mounted on the base plate, in line with each hammer, is a post having a coil mounted thereon. When the coils are de-energized, the magnetic field formed at the tips of the posts is adequate to overcome the spring force of the related hammer, whereby the air gap therebetween is closed and the hammer is cocked. Energization of any coil by a pulse of appropriate polarity and magnitude cancels the magnetic pull created by the related magnetic segment and allows the related hammer to pull away from the related post. This action creates a dot as the released spring force causes the dot-printing tip of the related print blade to press a print-producing material (e.g., a ribbon) against a print receiving medium (e.g., a sheet of paper). Rather than defining a single column, the dot-printing tips define two or more columns.

24 Claims, 26 Drawing Figures

SEGMENTED-RING MAGNET PRINT HEAD

TECHNICAL FIELD

This invention relates to printing mechanisms for dot matrix printers and, more particularly, to print heads for serial dot matrix printers.

BACKGROUND OF THE INVENTION

In general, dot matrix printers can be separated into two types of printers—line printers and serial printers. Line printers include mechanisms for creating lines of dots substantially simultaneously as paper moves through the printers. A series of dots creates characters (or a design). Contrariwise, a serial dot matrix printer includes a head that is moved back and forth across the sheet of paper, either continuously or by steps. In the past, most such heads included a column of dot printing elements. As each column position of a character position is reached during printing the required number of dot printing elements are actuated to form dots. A series of dot columns creates a character (or part of a design). This invention is related to serial dot matrix type printers.

As noted above, in the past, most (but not all) print heads for serial dot matrix printers, have included a column of dot printing elements, usually seven or nine. Normally, the printing elements have taken the form of wires supported by guide members positioned so that one of the ends of the wires are arrayed in a column. The other ends of the wires are positioned so that the wires can be longitudinally moved by electromagnetically actuated drive mechanisms. In some instances, the other ends of the wires are attached to the movable element of the related electromagnetic drivers such that the wires are in retracted positions when the drivers are de-energized. In other instances, the wires are not permanently attached to the movable elements of the electromagnetic drivers. Rather, the wires are retracted to a withdrawn position by coil springs and the like when the related electromagnetic drivers are de-energized. Regardless of how assembled, when an electromagnetic driver is energized, the associated wire is moved longitudinally. Longitudinal movement creates a dot by pressing the "column" end of the wire against a ribbon that faces a piece of paper.

While serial dot matrix printers have been commercialized, prior art print heads used in serial printers have a number of disadvantages. For example, they are more complex and, therefor, less reliable, than desired. In addition, prior art serial dot matrix printer print heads require more actuating power than is desirable. For example, one such print head requires a linear ramp-up of current to about three (3) amps over a period of about six-hundred (600) mircroseconds. Obviously, this relatively high power draw requires that the coils of the electromagnetic actuators have a relatively large wire size in order to achieve an acceptable dot print head life in excess of several hundred million dot prints per printing element. Obviously, the use of relatively large wire increases the size and cost of the print head. Increased size, of course, increases the inertia of the head, whereby the head movement mechanism requires a relatively large driving power source. In addition to increasing costs, such prior art print head assemblies have the further disadvantage that their large power requirements emit large amounts of heat. As a result, large fans and the like are required to cool the head assemblies. Furthermore, those print heads that include wires mounted in guide members have the disadvantage that the guides and/or wires are subject to wear and, thus, frequent replacement.

Attempts have been made to overcome some of the foregoing disadvantages of print heads suitable for use in serial dot matrix printers by using permanent magnets, for example. In this regard, attention is directed to U.S. Pat. Nos. 3,592,311, 3,659,238, 3,672,482 and 4,037,704 as examples of prior art proposals to use permanent magnets in serial dot matrix printer print heads. For various reasons, such attempts have not been entirely successful. For example, they are still more complex than desired. Further, they are larger than desired. Proposals also have been made to use permanent magnets in line dot matrix printers. In this regard, attention is directed to U.S. Pat. Nos. 3,931,051, 4,033,255 and 4,044,668. Obviously line printers function in a different manner than serial printers. Thus, they have different design constraints, whereby technology that is useful in one type of printer is not necessarily useful in the other type of printer. For example, line printers of the type described in U.S. Pat. Nos. 3,941,051, 4,033,255 and 4,044,668 do not require that the dot printing elements be closely spaced together because the elements are oscillated across a character position. As a result, printing elements in the form of short pins, mounted on relatively wide hammers, can be used. Contrariwise, because serial printers have, in the past, required a column of closely spaced printing elements, the elements have taken the form of guided wires. Thus, different requirements have led to different structures being developed, and the foregoing observation that what will function in a line printer environment will not necessarily function in a serial printer environment and vice versa.

It is the object of this invention to provide a new and improved print head suitable for use in a serial dot matrix printer.

It is a further object of this invention to provide an uncomplicated print head for a serial dot matrix printer.

It is still a further object of this invention to provide a low-cost, inexpensive print head for a serial dot matrix printer.

It is yet another object of this invention to provide a print head suitable for use in a serial dot matrix printer that has substantially lower power requirements than prior art serial dot matrix printer print heads.

SUMMARY OF THE INVENTION

In accordance with this invention, a print head for a serial dot matrix printer is provided. The print head of the invention is, in essence, a cylindrical sandwich that includes a base plate, a ring magnet, a print hammer disc, and a series of neutralizing coils, mounted on posts. The ring magnet and the posts are mounted on the face of base plate such that the ring magnet surrounds the posts. Mounted on the other face of the ring magnet is the print hammer disc, which is formed of a magnetically permeable, resilient material. This disc includes a plurality of inwardly projecting arms (hammers), each of which overlies one of the posts. Mounted on the outer face of the hammers are dot printing elements. The ring magnet is a permanent magnet that creates a magnetic circuit for each print hammer that extends through the base plate and the associated post, both of which are formed of magnetically permeable materials.

The position of the plane defined by the tips of the posts, with respect to the plane of the print disc, is such that the print hammers can be drawn toward the posts, into a cocked position. The magnetic force produced by the permanent ring magnet is adequate to cock the hammers. The cocked hammers are released by the magnetic field produced by the coils when the coils are energized by pulses of appropriate magnitude and polarity. More specifically, the coil fields neutralize, the magnetic field created by the permanent magnet in the region of the posts, whereby the cocked hammers are released. The released hammers spring away from the post and impact the dot imprinting elements against a print receiving medium. Termination of the neutralizing pulses results in the hammers being recaptured immediately, i.e., without bouncing.

Preferably, the ring magnet is a segmented ring magnet. That is, rather than the entire ring structure being axially magnetized, only selected segments, one related to each print hammer/post combination, and aligned therewith, are magnetized. In addition, preferably, the magnetic force created by the segmented magnetic ring at the tips of the posts is only slightly greater than the mechanical spring force of a cocked print hammer. As a result, the magnitude of the neutralizing magnetic field is maintained low, whereby power requirements are minimized. Further, preferably, the air gap between a post and its related print hammer, when the hammer is in a mechanically neutral position, i.e., unflexed, is controlled by threading the post into the back plate such that the posts are axially movable.

In accordance with further aspects of this invention, the print head includes a face plate mounted on the print hammer disc, on the side facing away from the posts. The face plate is formed of a magnetically permeable material and concentrates flux in the region of the posts. Centrally located in the face plate is an aperture through which the dot printing elements project when the coils are energized to release the print hammers. In accordance with the more preferred embodiment of this invention, the dot printing elements are formed by print blades that include outwardly projecting dot-imprinting tips located at one end. The dot-imprinting tips lie in the center aperture in the face plate and the remainder of the blades lie in radial slots extending outwardly from the central aperture. Further, rather than defining a single column, the dot imprinting tips define two or more columns.

In accordance with still further aspects of this invention, preferably, the region of the face plate located between adjacent radial slots includes holes or apertures adapted to reduce the magnetic field interaction between adjacent magnetic circuits.

It will be appreciated from the foregoing summary that the invention provides an uncomplicated and, therefore, inexpensive to manufacture print head for a serial dot matrix printer. Not only is the print head structurally uncomplicated, it also has minimal energy requirements. Moreover, since wire guides are not needed (if the dot printing elements are made suitably short), the wire/guide wear disadvantage of many prior art print heads does not exist.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIGS. 8A–H illustrate the formation of a character using a print head having the print arm array illustrated in FIG. 6; and FIGS. 9A–K illustrate the formation of a character using a print head having the print arm array illustrated in FIG. 7.

DESCRIPTION OF THE PREFERRED EMBODIMENT

Figure 1:
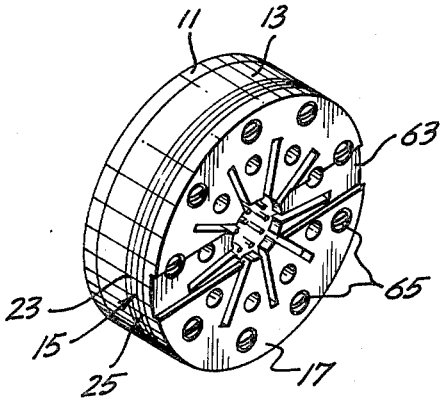
FIG. 1 is a pictorial view of a serial dot matrix printer print head formed in accordance with the invention.
Figure 2:
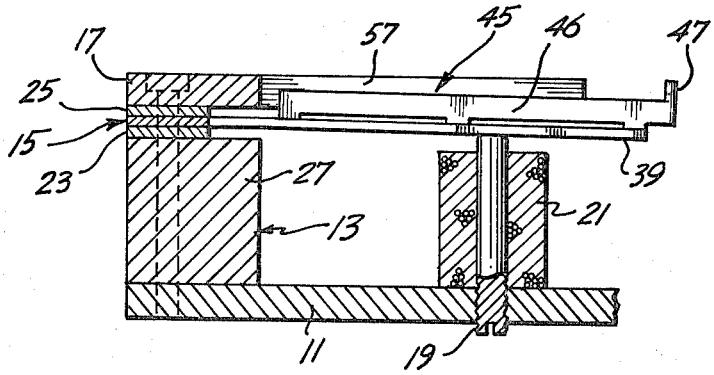
FIG. 2 is a radial cross-sectional view of one-half of the print head illustrated in FIG. 1, taken through one of the hammer assemblies.
Figure 3:
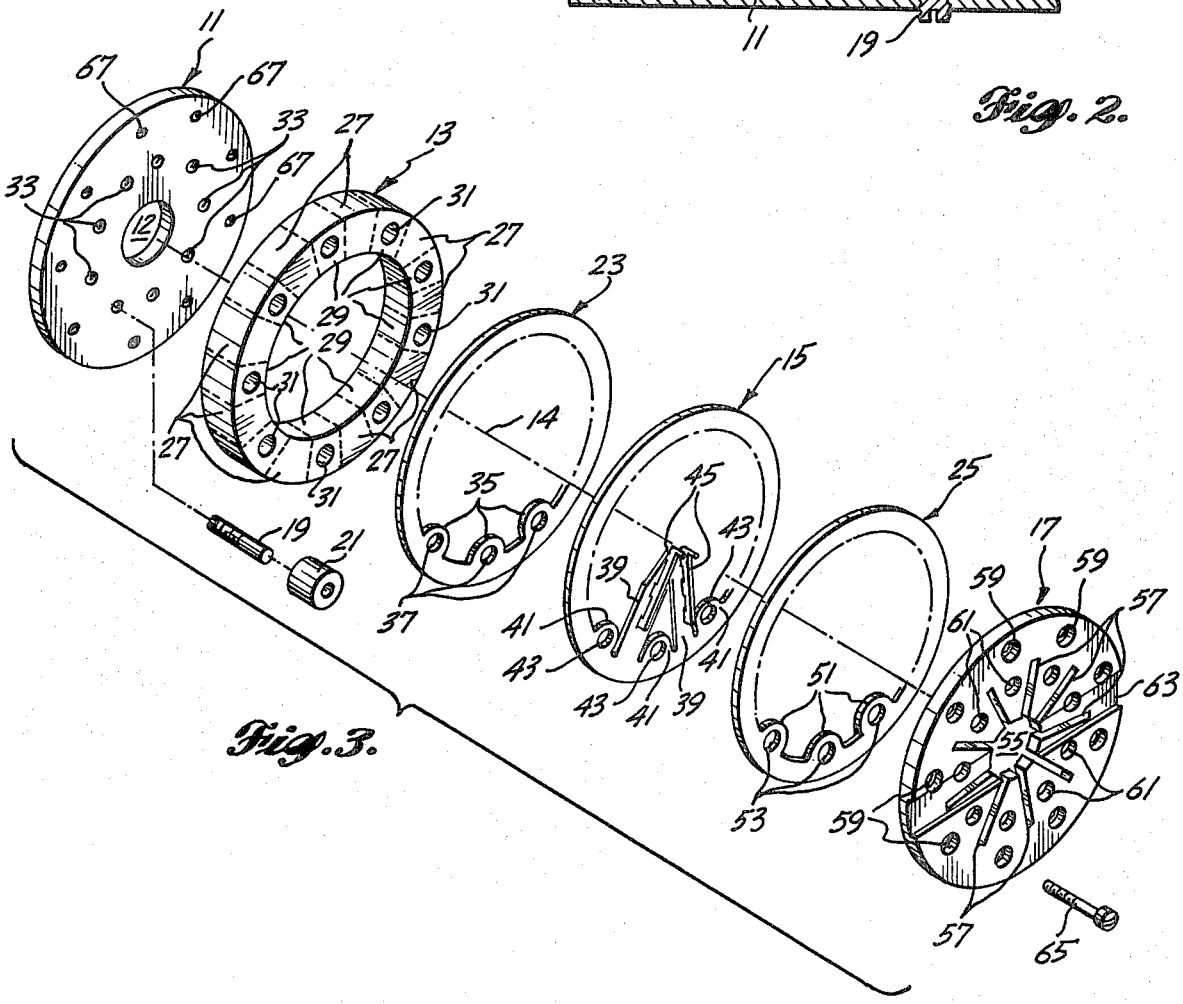
FIG. 3 is an exploded, pictorial view of the ring magnet print head illustrated in FIG. 1.

FIGS. 1–3 illustrate that preferred embodiments of print heads formed in accordance with the invention are, in essence, cylindrical, sandwich structures that comprise: a base plate 11; a ring magnet 13; a print hammer disc 15; a face plate 17; and, a series of posts 19 upon which coils 21 are mounted. While not absolutely necessary, the illustrated embodiment of the print head also includes first and second shims 23 and 25.

The base plate 11 is a cylindrical disc formed of a suitable magnetically permeable material, such as a magnetic steel and has a central aperture 12. The ring magnet 13 is a cylindrical ring having an outer diameter equal to the outer diameter of the base plate 11. The ring magnet 13 is mounted on one face of the base plate 11. The ring magnet is a permanent magnet, preferably a fully oriented, sintered ceramic magnet. The magnetic field produced by the ring magnet is axial. However, preferably, the entire ring is not magnetized. Rather only equally spaced regions (e.g., segments) 27 are magnetized. The magnetized segments 27 are separated by essentially nonmagnetized regions or segments 29, as illustrated in FIG. 3 by the dashed lines. A hole 31 is formed in each nonmagnetized segment 29, along an axis lying parallel to the central axis 14 of the ring magnet 13.

As illustrated in FIGS. 2 and 3, located in the base plate, a predetermined radial distance from the center of the base plate 11, are a series of threaded apertures 33, equal in number of the number of magnetic segments 27 of the magnetic ring 13, nine (9), for example. The threaded apertures 33 are equally spaced from one another, and when the ring magnet 13 is attached to the base plate 11 as hereinafter described, a threaded aperture is radially aligned with each magnetic segment 27. Mounted in each of the threaded apertures 33 is a post 19. The posts extend outwardly from base plate 11 on the same side as the ring magnet 13 and, thus, are surrounded by the ring magnet. As best illustrated in FIG. 2, preferably the length of the posts surrounded by the ring magnet is substantially equal to the thickness of the ring magnet. Further, the threaded end of the posts, which extend through the base plate 11, are slotted so as to be able to receive the blade of a screwdriver. The posts are formed of a suitable magnetically permeable material, such as magnetic steel, for example. Mounted on each post 19 is a coil 21.

Mounted on the face of the ring magnet 13 opposed to the face juxtaposed with the base plate 11 is the first shim 23. The first shim is a thin ring formed of a suitable magnetically permeable material, such as magnetic steel. The first shim includes a plurality of inwardly projecting planar flanges 35 equally spaced and equal in number to the number of nonmagnetic segments of the ring magnet (e.g. nine). Each flange 35 includes a hole 37 positioned so as to be alignable with the holes 31 in the ring magnet 13.

Mounted on the inner shim 23 is the print hammer disc 15. The print hammer disc 15 is a thin flat disc having a plurality of planar inwardly projecting arms (hammers) 39. The hammers 39 are equally spaced and equal the number (e.g., nine) of magnetic segments 27 of the ring magnet 13. (For ease of illustration only two hammers are shown in FIG. 3)

Figure 4:
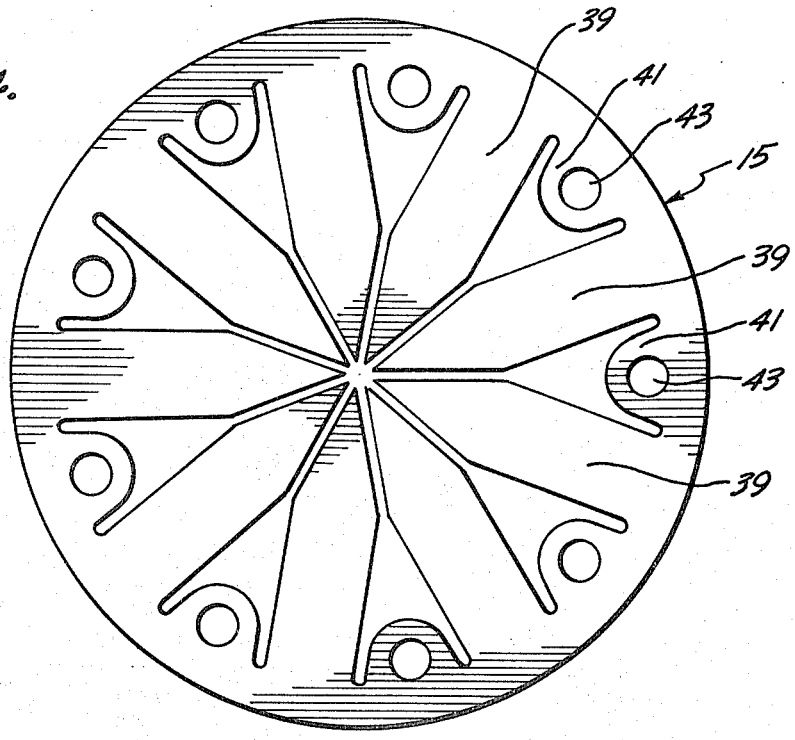
FIG. 4 is a plan view of a print hammer disc suitable for use in the print head illustrated in FIG. 1.

As best illustrated in FIG. 4, in the inward direction, the edges of the hammer start out parallel and, near the center of the disc converge toward a point. The pointed regions are, of course, spaced from one another so that each hammer is independently movable as herein described. Located between each hammer 39 of the print hammer disc 15 is an inwardly projecting planar flange 41. Because the hammers 39 are aligned with the magnetic segments 27 of the ring magnet 13, the flanges 41 are aligned with the nonmagnetic segments 29. Each flange 41 of the print hammer disc 15 includes a hole 43 positioned so as to be alignable with a hole 37 in the first shim 23.

The print hammer disc 15 is formed of a resilient, magnetically permeable material. More specifically, the print hammer disc is formed of a resilient or spring material that is also magnetically permeable. The material may, for example, be a soft magnetic iron, heavily rolled and partially annealed to achieve the desired resilient strength.

Figure 5:
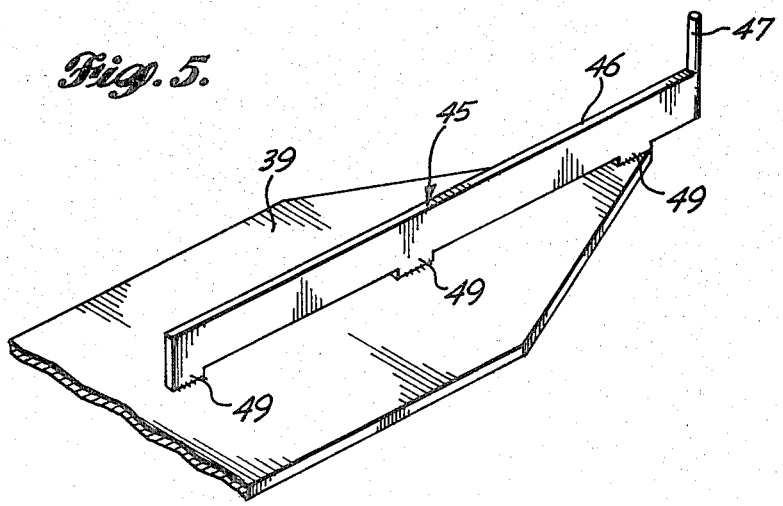
FIG. 5 is a pictorial view illustrating the attachment of a print blade to a hammer of the print hammer disc illustrated in FIG. 4.
Figure 6:
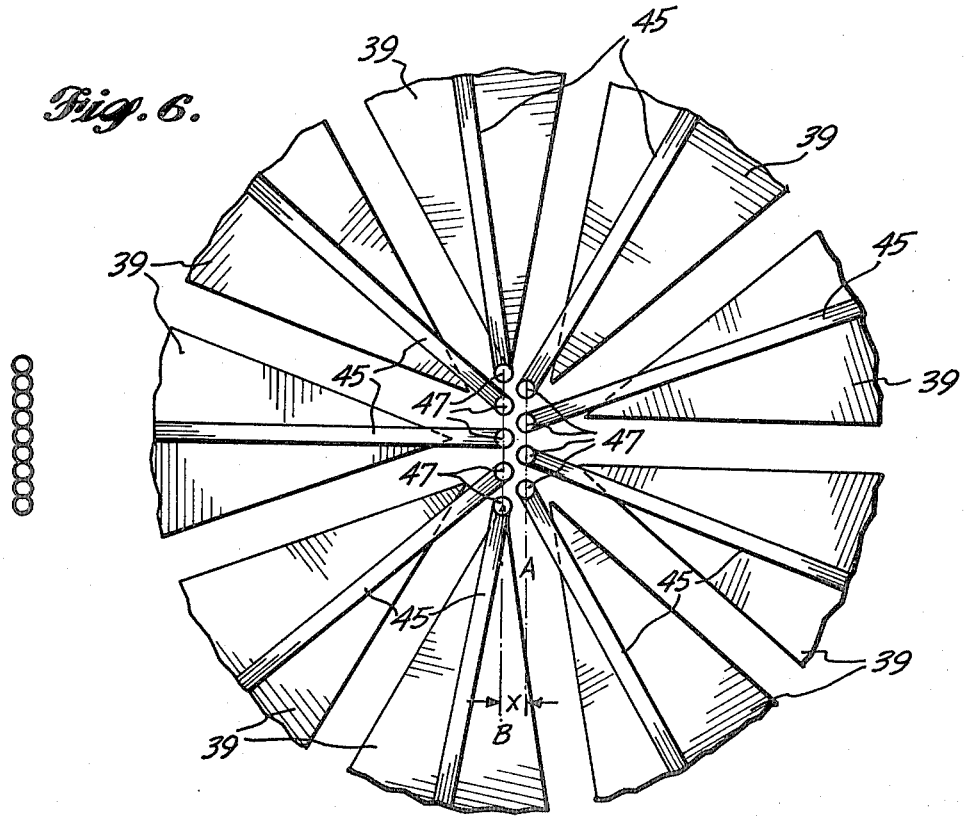
FIG. 6 is an enlarged, partial-plan view illustrating one manner of positioning print on the hammers of a print hammer disc.
Figure 7:
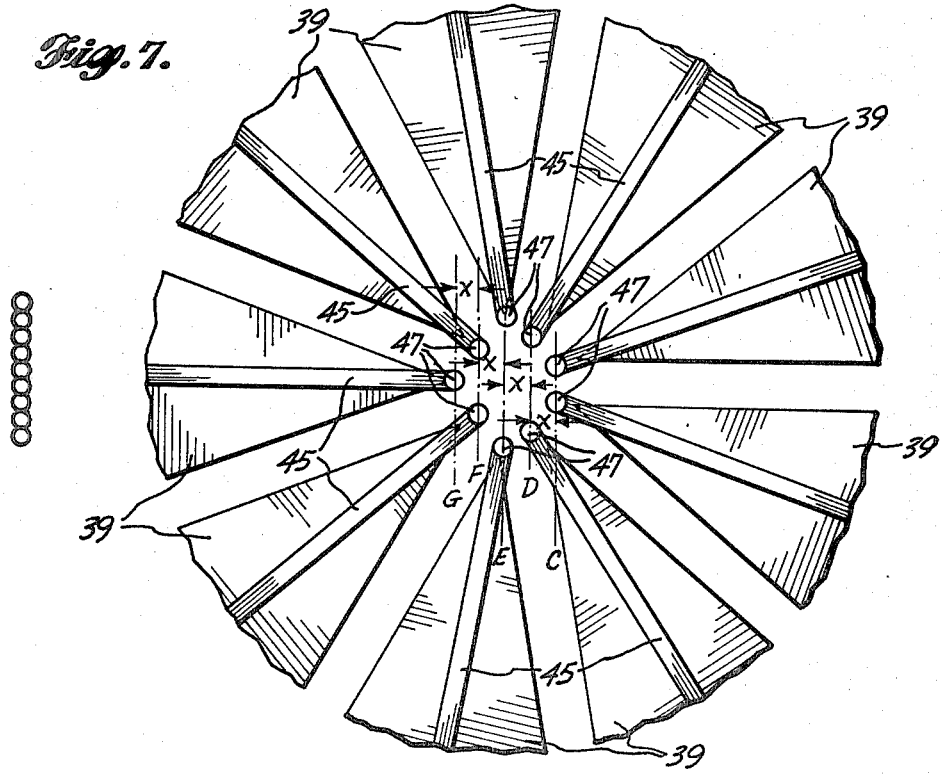
FIG. 7 is an enlarged, partial-plan view illustrating an alternate manner of positioning print arms on a print hammer disc.

Mounted on the side of each hammer 39 opposed to the side facing the posts 19 is a print blade 45. As best illustrated in FIG. 5, each print blade 45 comprises a flat, elongated blade-like region 46 and a print arm 47 projecting orthogonally outwardly from one of the ends thereof, in the plane of the flat, elongated blade-like region 46. The tips of the print arm are circular in cross section. The print blades 45 are mounted on the print hammers 39 such that the plane defined by each print blade lies orthogonal to the plane defined by its associated hammer. The longitudinal axes of the print blades 45 lie generally (but not necessarily exactly) along the longitudinal axes of the hammers 39. The print blades 45 are positioned such that their respective print arms lie parallel to one another. Two preferred print arm arrays are illustrated in FIGS. 6 and 7, and decribed in detail below.

Preferably several protrusions 49 are located along the longitudinal edge of the print blades 45 that contact the hammers 39. The protrusions are welded to the adjacent region of the hammer 39. (Since it is desired that the print blades stiffen the hammers to maximize the transfer of impact energy from the hammer to the paper, a continuous weld, produced by laser welding, for example, may be preferred in an actual embodiment of the invention.) The print blades 45 are formed of a hardenable wear resistance metal, which may or may not be magnetically permeable.

As with the first shim 23, the second shim 25, which lies adjacent to the print blade side of the print hammer disc 15, is a thin ring formed of a suitable magnetically permeable material, such as magnetic steel. The second shim 25 includes a plurality of inwardly projecting planar flanges 51 equally spaced and equal in number to the number of nonmagnetic segments of the ring magnet 13. Each flange 51 includes a hole 53 positioned so as to be alignable with a hole 43 in the print hammer disc 15.

The face plate 17 is a disc that is also formed of magnetically permeable material, such as magnetic steel. The face plate is thicker than the shims of the print hammer disc. The face plate includes a circular central aperture 55 from which a plurality of radial slots 57 project. The slots are equal in number to the number of hammers 39 of the print hammer disc 15. Located about the outer periphery of the face plate 17 are a plurality of bolt holes 59. The bolt holes are undercut (i.e, larger on one side than on the other) and one bolt hole lies between each pair of adjacent radial slots 57. The bolt holes are positioned so as to be alignable with the holes 53 in the flanges 51 of the second shim 25. The face plate includes a second set of holes 61 located inwardly of the bolt holes 59 (along radial lines). Finally, the surface of the side of the face plate opposed to the side facing the second shim, includes a diagonally oriented ribbon slot 63.

The print head is assembled by threading the posts 19 into the base plate after mounting these coils on the posts and, then, juxtaposing the base plate 11, the ring magnet 13, the first shim 23, the print hammer 15, the second shim 25 and the face plate together in that order so that the bolt holes in the face plate align with the holes in the first and second shims 23 and 25, the print hammer disc 15 and the ring magnet 13. Thereafter bolts 65 are mounted in the aligned holes and screwed into threaded apertures 67 located about the periphery of the base plate 11. When assembled in this manner, the flat, elongated blade-like region 46 of the print blades lie in the radial slots 57 in the face plate 17. In addition, the print arms 47 of the print blades lie in the central aperture 55 in the face plates. As noted above, the print arms lie parallel to one another. While lying parallel, the outer tips may take on different configurations. Two such configurations are illustrated in FIGS. 6 and 7, and are next described.

As noted above, the illustrated embodiment of the invention has nine print hammers 39. Thus, the embodiment includes nine print blades, each of which can produce a dot. In the FIG. 6 print arm 47 configuration, the print arms define two vertical columns. One of the columns (A) is defined by four print arms and the other column (B) is defined by five print arms. The print arms defining each column are spaced from one another. Further, the print arms of one column are positioned to be overlappingly in line with the gaps between the arms of the other column. The amount of overlap is, of course, slight. As a result, if the print arm columns were brought together, they would define a continuous (overlapping) line, nine print arms long, as illustrated on the left of FIG. 6. As a result, it can be readily seen that if: (a) the tips of one column form a column of dots; (b) the other column is moved to a position that overlies the dots produced by the first column; and, (c) after being so positioned, the tips of the second column form a column of dots, a continuous line of overlapping dots is formed. Not only do the print arms overlap vertically, the columns they define may also overlap horizontally (i.e., in the direction of head movement). In any event, the spacing, X, between the columns, A and B, is chosen to correspond to the desired horiziontal dot spacing distance in order for the electronics controlling the print hammers to simultaneously release the necessary print hammers in each column, as will be better understood from the following discussion of FIGS. 8A–8H.

FIG. 7 illustrates an arrangement wherein the print arms 47 define, in essence, five vertical columns (C, D, E, F and G), rather than two vertical columns (A and B). (One of the "columns", G, is defined by a single print arm.) In a very general manner, the columns define a circle. Further, horizontally, the columns are spaced apart by equal amounts. As with the two column array illustrated in FIG. 6, the five column array can create a single vertical line of overlapping dots. In this regard, the fifth column, G, defined by the single print arm produces a dot that is overlapped by the two dots produceable by the print arms defining the first column, C, which in turn are overlapped by the two dots produceable by the print arms defining the fourth column, F. The dots produced by the fourth column print arms are overlapped by the dots produceable by the arms defining the second column, D, which in turn are overlapped by the two dots produceable by the print arms defining the third column, E. Again, column spacing, X, is chosen so that the print hammers can be simultaneously released, as will be better understood from the following discussion in FIGS. 9A–9K.

Turning now to a discussion of the operation of the print head of the invention, as will be understood from the foregoing description, a separate magnetic circuit is defined by each magnetic segment 27 of the ring magnet 13, the adjacent region of the base plate 11, the related post 19 and the related hammer 39 of the print hammer disc 15. These elements (and region) form a primary magnetic circuit. A secondary or overflow magnetic circuit is formed by each magnetic segment of the ring magnet, the adjacent region of the base plate, and the region of the face plate 17 lying on either side of the slot within which the related print blade lies. Normally the primary magnetic circuit forms the overriding magnetic flux path. As a result, the hammers 39 are drawn into contact with the posts 19.

Because the plane of the print hammer disc 15 is spaced from the plane defined by the tips of the posts (by approximately the thickness of the inner shim 23), the hammers 39 are mechanically stressed, as shown in FIG. 2. When so stressed, the hammers are defined as being in their cocked position. Thus, the cocked position is the elastically strained position of the hammers 39. Thus, the cocked position is the elastically strained position of the hammers 39. In this position, absent the application of external power to the coils 21, the hammers are ready to produce a dot. When an electrical energy pulse of proper magnitude and polarity is applied to the coil related to a particular hammer, the magnetic flux in the primary magnetic circuit is transferred to the secondary magnetic path, whereby the hammer is released and swings away from its associated post. The swing force is created by stored potential energy created by cocking the hammer. When released the hammer's potential energy is converted into kinetic energy. The hammer, moving with kinetic energy, produces a dot. Specifically, a dot is produced by the tip of the print arm 47 driving a ribbon, riding in the slot 63 in the face plate 17, against paper supported by a platen in a conventional manner. (Since ribbons, ribbon movement mechanisms, plates and other parts of dot matrix printers are well known and form no part of the present invention, they are not described here.)

It is pointed out here that the "stored" energy hammers of the invention have a significant advantage over prior art print heads that pull wires toward a ribbon. Specifically, the stored energy hammers of the invention transfer print energy at peak velocity, but at minimum acceleration. Contrariwise, pull wire leads are accelerating at impact. The end result is that the tolerance requirements of stored energy print heads are substantially less than pull wire print heads. Moreover, print element wear is less.

It will be appreciated that it is desirable to use the minimum amount of electrical energy to release each individual hammer. In order to attain this result, it is necessary that the air gap between the hammers 39 and the posts 19 (when the print hammers are in their planar position) be the same for all hammer/post combinations. (Of course the coils must be similar, the thicknesses of the magnetic ring and first shim must be constant, and all items relatively accurately machined. However, these results are relatively easy to accomplish.) In accordance with the invention, the hammer/-post air gap is controlled by adjusting the length of the posts. Post adjustment is accomplished by rotating the posts in their threaded apertures until the desired position is achieved. After the posts are suitably positioned, they are locked in position by lock nuts (not shown) or by applying a locking epoxy to the theaded end of the posts and allowing the epoxy to cure. Magnetic circuit cross-coupling, which could also effect hammer release action (due to one magnetic circuit affecting an unrelated hammer), is reduced by the second set of holes 61 formed in the face plate. In this way, each magnetic circuit can be adjusted for minimum release energy.

In summary, the basic concept of the ring magnet print head is best seen in FIG. 2. When no current is flowing in the coils, a magnetically generated force, produced by the ring magnet, causes the hammers to be pulled against the tips of the posts, eliminating the air gaps that would normally exist between the hammers and the posts if no force were acting on the hammers. Thus, during the time when the costs are nonenergized, the hammers are in an elastically defined position and possess potential energy. That is, the hammers are cocked. When an electrical current of correct polarity and magnitude is applied to any one of the coils, magnetic flux is induced that cancels the permanent magnetic flux created by the ring magnet in the post. With zero flux in the post tip, there is zero force to restrain the hammer in a cocked state. As a result, the hammer flies away from the post at a speed determined by the natural resonant frequency of the hammer. As the hammer flies away from the post, its potential energy is transformed into kinetic energy, which is used to print dots. When the current in the coil is again returned to zero, the hammer is pulled back to the post by the magnetic flux produced in the post by the ring magnet. By appropriately timing, coil current can be reduced to zero rapidly enough for the hammers to be recaptured without bounce, i.e., during the rebound from the dot producing swing.

It is to be understood that all of the dots of a particular column are not simultaneously produced by the print head of the invention, as is the case with prior art print heads that include a series of wires that terminate in a column. Rather, the dots of a particular column are formed at different times. If the head includes the print arm arrangement shown in FIG. 6, dot print timing is such that (assuming the head is moving from left to right) the print arms of column A first produce dots and then the print arm of column B produce dots. In this regard attention is directed to FIGS. 8A–H.

Figure 8A:
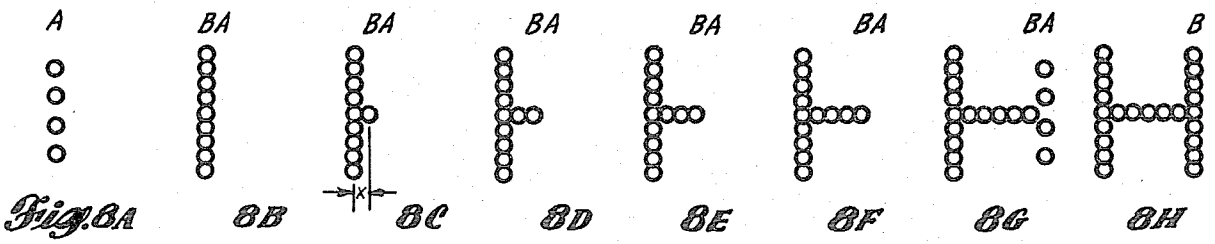

FIGS. 8A–H comprise an exemplary, sequential view of the formation of a single character (an H) as a print head of the type illustrated in FIG. 6 moves across a sheet of paper. First the A column reaches the position of the left leg of the H. Since the left leg of the H requires a complete row of dots, all of the hammers driving the print arms of the A columns are released. As a result four dots are printed, as illustrated in FIG. 8A. As the print head continues to move (or is stepped), column B reaches a position where it overlies the four printed dots. When this position is reached all of the hammers driving the print arms of column B are released, and the left leg of the H is completed, as illustrated in FIG. 8B. At this time no column A print arms are released because the cross-member of the H is in the center and the center print arm is in column B.

The print head next reaches a position where column B lies next to the completed left leg of the H. At this point, the hammer driving the central print arm of column B is released and the first dot of the cross-member of the H is produced, as shown in FIG. 8C. This action continues as the head moves (i.e., central dots are produced by the center print arm of the B column) until a row of four (4) dots are formed, as shown in FIGS. 8D, 8E and 8F.

When the print head next reaches a position where column B overlies the position of the last-member dot, the center print arm of the B column creates a further dot. Since column A overlies the position of the right leg of the H and since the right leg is a continuous line, the hammers driving all of the print arms of the A column are released at the same time. The result is illustrated in FIG. 8G. Next the print head moves to a position where the B column overlies the position of the right leg of the H. When this position is reached, the hammers driving all of the print arms of column B are released, and the H is complete as shown in FIG. 8H. In this way, a 7×9 dot matrix H is created.

Figure 9A:
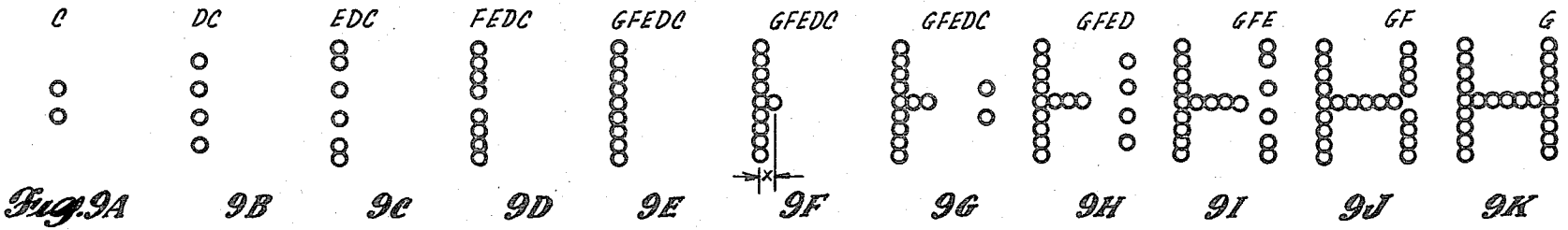

The creation of a character, such as an H, by a print head having a print arm array of the type illustrated in FIG. 7 is operated in a similar manner, except that the number of steps is greater. In this regard, attention is directed to FIGS. 9A–K. First column C, then columns D, E, F and G have all of their hammers released as the columns sequentially pass the position of the left leg of the H, as shown in FIGS. 9A–E. As the print head continues to move, column G only has its single print arm actuated, since column G comprises the center dot printing element of the array, as shown in FIG. 9F. When column G reaches a position alongside this single central dot, column C overlies the position of right leg of the H. Thus the hammers actuating the print arms of columns C and G are released. See FIG. 9G. Next the print arms of column D and G are actuated (FIG. 9H); then, the print arms of columns E and G (FIG. 9I); and, then the print arms of columns F and G (FIG. 9J), as the print head continues to move. Finally, when column G overlies the position of the right leg of the H, its single print arm is actuated, and the H is completed (FIG. 9K). Obviously, while one character is being completed, parts of the next adjacent character are being formed, as the columns of the print head overlie the appropriate dot position of the next character.

As noted above, regardless of the nature of the print arm array; the print head can be either moved continuously or stepped. Further, other print arm arrays can be used, if desired. Also matrices other than a 7×9 array, such as a 5×7 array, can be used. Consequently, while preferred embodiments of the invention have been illustrated and described, it is to be understood that various changes can be made therein within the spirit and scope of the invention. In this regard, it should also be noted that the shims can be deleted if desired, provided that the posts are suitably positioned (to provide the necessary hammer cocking gap) and the face plate and/or the ring magnet includes a ring shaped shoulder (so that the hammers do not bounce off the face plate). Hence the invention can be practiced otherwise than as specifically described herein.

The embodiments of the invention in which an exclusive property or privilege is claimed are defined as follows:

1. A print head for a serial dot matrix printer comprising:

a base plate;

a ring magnet formed of a permanently magnetized material, said ring magnet being axially magnetized and mounted on one face of said base plate;

a plurality of electromagnetic elements mounted on the same face of said base plate as said ring magnet so as to be surrounded by said ring magnet;

a plurality of hammers, equal in number to the number of electromagnetic elements, mounted on said ring magnet, said plurality of hammers being planar and formed of a resilient, magnetically permeable material, said plurality of hammers being mounted such that a hammer overlies each electromagnetic element and forms a magnetic flux path between said ring magnet and its associated electromagnetic element, said hammers being positioned such that each hammer is drawn from an unstressed planar state into a stressed cocked state by said ring magnet pulling hammers toward their associated electromagnetic elements, said pulling action occurring in the absence of the application of electric power to said electromagnetic elements; and, a plurality of dot printing elements equal in number to said number of hammers, one of said dot printing elements mounted on each of said hammers.

2. A print head for a serial dot matrix printer as claimed in claim 1 wherein said axially magnetized ring magnet includes a plurality of magnetized segments separated by nonmagnetized segments, said magnetized segments being equal in number to said plurality of hammers and positioned such that a magnetized segment is aligned with each of said plurality of hammers.

3. A print head for a serial dot matrix printer as claimed in claim 2 wherein each of said electromagnetic elements comprises a post mounted on said base plate and a coil surrounding said post, said post being formed of a magnetically permeable material.

4. A print head for a serial dot matrix printer as claimed in claim 3 wherein said posts are threaded into said base plate such that the length of post extending from said base plate and surrounded by said ring magnet is adjustable.

5. A print head for a serial dot matrix printer as claimed in claim 4 wherein said plurality of hammers comprises a disc formed of a resilient, magnetically permeable material and a plurality of arms extending inwardly from said disc, each of said arms forming one of said plurality of hammers.

6. A print head for a serial dot matrix printer as claimed in claim 5 wherein each of said plurality of dot imprinting elements comprises a blade orthogonally mounted on its related hammer, said blade including an outward projection mounted near the inner end of said hammer, said outward projection forming a print arm having a dot defining tip.

7. A print head for a serial dot matrix printer as claimed in claim 6 wherein said print arms of said print blades lie parallel to one another.

8. A print head for a serial dot matrix printer as claimed in claim 7 wherein said parallel axes define at least two dot printing columns.

9. A print head for a serial dot matrix printer as claimed in claim 6 including a face plate mounted on said disc.

10. A print head for a serial dot matrix printer as claimed in claim 9 wherein said face plate includes a central aperture through which said print arms of said print blades extend.

11. A print head for a serial dot matrix printer as claimed in claim 10 wherein said face plate includes a plurality of radial slots, said radial slots positioned such that said blades lie in said radial slots.

12. A print head for a serial dot matrix printer as claimed in claim 9 wherein said base plate is formed of a disc of magnetically permeable material.

13. A print head for a serial dot matrix printer as claimed in claim 12 including a first shim mounted between said ring magnet and said disc, said shim being formed of a magnetically permeable material.

14. A print head for a serial dot matrix printer as claimed in claim 13 including a second shim located between said print disc and said face plate, said second shim also being formed of a magnetically permeable material.

15. A print head for a serial dot matrix printer as claimed in claim 1 wherein each of said electromagnetic elements comprises a post mounted on said base plate and a coil surrounding said post, said post being formed of a magnetically permeable material.

16. A print head for a serial dot matrix printer as claimed in claim 15 wherein said posts are threaded into said base plate such that the length of post extending from said base plate and surrounded by said ring magnet is adjustable.

17. A print head for a serial dot matrix printer as claimed in claim 1 wherein said plurality of hammers comprises a disc formed of a resilient, magnetically permeable material and a plurality of arms extending inwardly from said disc, each of said arms forming one of said plurality of hammers.

18. A print head for a serial dot matrix printer as claimed in claim 1 wherein each of said plurality of dot imprinting elements comprises a blade orthogonally mounted on its related hammer, said blade including an outward projection mounted near the inner end of said hammer, said outward projection forming a print arm having a dot defining tip.

19. A print head for a serial dot matrix printer as claimed in claim 18 wherein said print arms of said print blades lie parallel to one another.

20. A print head for a serial dot matrix printer as claimed in claim 19 wherein said parallel axes define at least two dot print columns.

21. A print head for a serial dot matrix printer as claimed in claim 18 including a face plate mounted on said disc.

22. A print head for a serial dot matrix printer as claimed in claim 21 wherein said face plate includes a central aperture through which said print arms of said print blades extend.

23. A print head for a serial dot matrix printer as claimed in claim 22 wherein said face plate includes a plurality of radial slots, said radial slots positioned such that said blades lie in said radial slots.

24. A print head for a serial dot matrix printer as claimed in claim 1 wherein said dot printing elements define at least two columns.

* * * * *